United States Patent [19]

Jones et al.

[11] Patent Number: 4,694,727

[45] Date of Patent: Sep. 22, 1987

[54] SITU DISPOSABLE GEL CANISTER

[75] Inventors: Lloyd G. Jones, Dallas; Lawrence R. Stowe, Plano, both of Tex.

[73] Assignee: Mobil Oil Corporation, New York, N.Y.

[21] Appl. No.: 771,929

[22] Filed: Sep. 3, 1985

[51] Int. Cl.[4] ..... F42B 3/00

[52] U.S. Cl. ..... 86/20.15; 86/20.12; 264/3.1; 102/313

[58] Field of Search ..... 102/307, 312, 313; 264/3.1, 3.2; 86/20.12, 20.15

[56] References Cited

U.S. PATENT DOCUMENTS 3,943,208 3/1976 Ratte et al. ..... 102/531 X
4,039,030 8/1977 Godfrey et al. ..... 166/299
4,151,798 5/1979 Ridgeway ..... 102/307 X
4,337,218 6/1982 Byrd et al. ..... 102/289 X
4,365,556 12/1982 Reibel ..... 102/307

*Primary Examiner*—Peter A. Nelson
*Attorney, Agent, or Firm*—Alexander J. McKillop; Michael G. Gilman; Charles A. Malone

[57] ABSTRACT

A method and apparatus for making an in situ disposable propellant canister for utilization in controlled pulse fracturing. Said canister is composed of a porous light fabric material in combination with a gel solution. The gel creates a formable mass after solidification. Said mass can be made of a gel thickness sufficient to support and contain a propellant. Upon ignition of said propellant, the gelled canister is destroyed thereby alleviating a clean up operation.

14 Claims, 2 Drawing Figures

SITU DISPOSABLE GEL CANISTER

This invention relates to a method and means for containing a propellant or explosive which is used in high energy or controlled pulse fracturing.

BACKGROUND OF THE INVENTION

Stimulation of wells through mechanical fracturing can be accomplished by a method known as controlled pulse fracturing or high energy gas fracturing. A good description of this method appears in an article by Cuderman, J. F., entitled "High Energy Gas Fracturing Development," Sandia National Laboratories, SAND 83-2137, October 1983. Using this method enables the multiple fracturing of a formation or reservoir in a radial manner which increases the possibility of contacting a natural fracture. In the practice of this method, a canister containing a propellant is suspended into a wellbore. This canister is placed downhole next to the oil or hydrocarbonaceous fluid productive interval.

The canister can be made of plastic or metal. While metal canisters can be used, a potential debris problem can arise during well cleanout, maintenance and production. Plastic canisters can be bailed, drilled, or pumped from the wellbore, however, their removal may damage the wellbore.

To avoid the debris problem caused by metal and plastic propellant canisters, it is desirable to have a method and means for disposing of the canister within the wellbore without presenting a debris cleanout problem and which will not damage the wellbore. The present invention is directed to a method and means for disposing of the propellant or explosive container within the wellbore which avoids the debris cleanout problem. Wellbore damage is also minimized.

SUMMARY

This invention relates to a method for making a disposable propellant device for utilization in high energy or controlled pulse fracturing.

In the practice of this invention, a disposable outer liner is constructed of a flexible porous material which is consumable upon ignition of a propellant or explosive subsequently placed into said liner. Afterwards, said porous material is impregnated with a consumable, solidifiable gel which can form a solid liner of a thickness capable of holding said propellant or explosive. Later, the gel is solidified and forms a solid liner. Subsequently, a propellant or explosive means, along with a means for igniting said propellant or explosive means is enclosed in said liner. After being enclosed, the device is inserted into the desired wellbore for utilization. When the propellant or explosive means is ignited, said solidifed canister decomposes.

It is therefore an object of the present invention to provide a method which will obviate the need to remove the canister remnants from the wellbore.

It is another object of this invention to provide a method which will facilitate varying the density of the gel canister to increase its strength.

Yet another object of the present invention is to minimize damage to a wellbore of formation when removing the canister.

A further object of the present invention is to provide for a method which will allow for variations in the stability and rigidity of the gelled canister or container as required.

DESCRIPTION OF PREFERRED EMBODIMENTS

Figure 1:
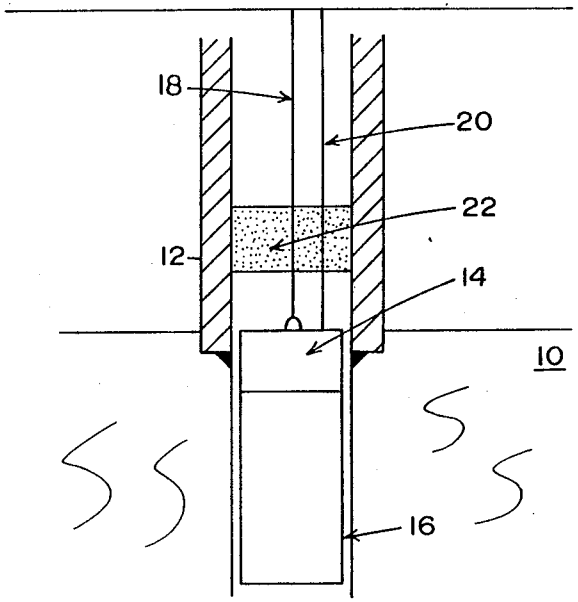
FIG. 1 is a graphic representation of a canister containing the propellant before ignition.

FIG. 1 shows the relationship of the solidified gel canister utilized in this invention along with other members used in controlled pulse fracturing.

Figure 2:
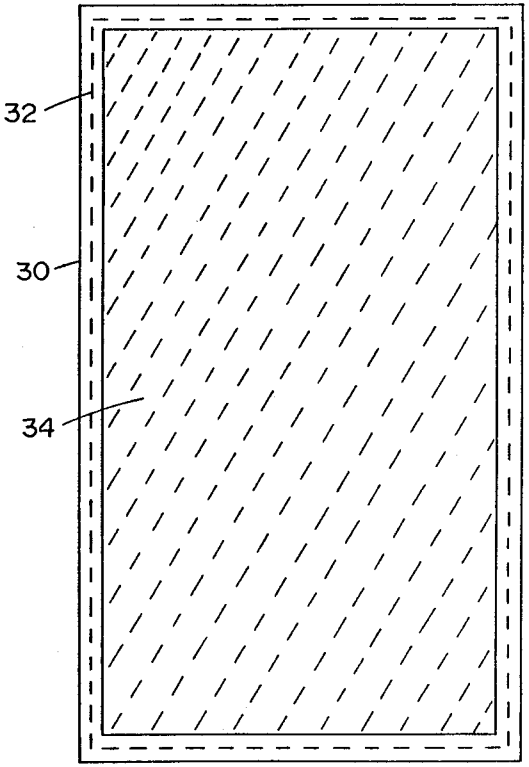
FIG. 2 is a cross-sectional view of the disposable gelled canister.

Referring to FIG. 1, a solidified canister containing a propellant 16 is placed into a wellbore 12 which penetrates a hydrocarbonaceous fluid producing formation 10. Canister 16 is suspended into the wellbore 12 via a retrieval means, which generally will be a cable 18. In order to ignite the propellant contained in the canister 16, a means for igniting the propellant is connected to the retainer stem 14. The retainer stem 14 forms an integral part of said canister and is positioned on its upwardly directed end. Preferably, retainer stem 14 is made in a manner similar to gel canister 16, thus becoming an integral and unified part of said canister. The other end of the means for ignition is connected or affixed to a location at or above ground level above wellbore 12. The means for igniting will generally be a conduit 20 containing an electrical wire which wire can be used to generate an electrical spark within canister 16 containing the propellant. Conduit 20 and cable 18 are directed through plug stem or cover seal 22 for connection to a support means outside of and above said wellbore 12. FIG. 2 shows a cross-sectional view of canister 16.

To prevent canister 16 from causing a removal problem after deflagration of a propellant contained therein, the canister is made of materials which are destroyed upon ignition of the propellant or explosive therein. Pressures generated upon ignition will vary from about 10,000 psig to about 80,000 psig. Instantaneous heat generated upon ignition of the propellant may be grater than about 1,000° F. in the vicinity of the deflagration but is quickly dissipated with propagation.

The disposable canister or device of the present invention is made by forming a flexible porous material 30 into a desired shape. Generally, this shape will be cylindrical. Flexible porous material 30 which can be utilized include nylon materials which is of a gauge sufficient to be used in women's stockings. This gauge is sufficient to prevent the liquified gel from flowing through said material. Another material which can be used is plastic screening which is found in most home screens.

The disposable outer liner 30 is placed into a mold of a cylindrical shape and about four inches across. Into these openings at the top of said mold is placed a smaller mold which is suspended so as to provide about one inch of space at the bottom and sides of said mold. A liquefied gel capable of solidification is placed in the space within said mold. The gel impregnates the porous material 30, which is suspended within said gel, and fills the space. The gel is then allowed to solidify thus forming the bottom and sides of canister 16. Sufficient space is left at the top of said mold for forming the top of the canister. Subsquently, the smaller mold is removed which leaves a void for placement of a propellant. A desired propellant 34 is placed within said void. Thereafter, additional gel is placed over the propellant which gel is sufficient to form the top of the canister 16. After the gel has solidified, the outer mold is removed and the canister containing the propellant is ready to be connected for suspension into wellbore 12. The canister closure is now complete.

Gel mixtures can be varied to obtain the desired stability and rigidity. A preferred mixture used to obtain the desired stability and rigidity, for example, is a mixture of hydropropyl guar cross linked with transitional metals and ions thereof. The purpose of the transitional metal ions is to provide increased strength, stability and rigidity for the gel canister 16.

Hydropropyl guar is placed into the gel mixture in an amount of from about 0.70 to about 10.0 weight percent of said mixture. As preferred, hydropropyl guar is placed in said mixture in about 7.2 percent by weight of said mixture.

Metallic ions which can be used in the gel mixture include titanium, zirconium, chromium, antimony and aluminum. The concentration of these transitional metals in the gel fluid will of course vary depending upon the requirements for the particular propellant being used and the nature of the wellbore and formation into which the canister containing the propellant is placed. Although the exact amounts of the metals required will vary depending on the particular application, it is anticipated that the metals should be included within the pumpable gel fluid in amounts of from about 0.005 weight percent to about 0.50 weight percent, preferably about 0.01 weight percent of said pumpable gel fluid mixture.

In one embodiment of the practice of this invention, a slurry is formed with 1,000 gallons of water. This slurry comprises about 40 pounds of base gel such as hydroxypropyl guar gum which forms a hydrate in the water. To this mixture is added about 600 pounds of chemically treated hydroxypropyl guar gum which has delayed hydration or thickening qualities. Approximately 20 pounds of a buffer or catalyst suitable to obtain the desired pH and reaction time is added to this mixture. Cross-linking agents, such as borates and chromates, are then added in an amount of about 20 pounds.

There are several methods of preparing the types of polymer systems which are used to obtain the solidified gel canister described herein. The ranges of polymer, buffer, and crosslinker concentrations given encompass two primary methods of forming said solidified gel canister.

The first method involves guar gum or hydroxypropyl guar as the base polymer. These products are widely used in the petroleum and food industries and are commercially available from chemical suppliers such as Celanese, Henkel, Hercules, and Millmaster Onyx. For this method, base gel containing the described concentration of 40 lbs per 1000 gallons of water (several types of water such as 2% KCl water, city water, formation water, etc. are used) is mixed into a holding tank at the surface (500 bbl frac tank, for example). The purpose of the base gel is to suspend additional unhydrated guar or hydroxypropyl guar (up to 600 or so lbs/1000 gals). The "secondary" polymer is pre-treated by the supplier with glyoxal or similar material to retard hydration. A buffer (such as sodium acetate or sodium pyrophosphate) is added with the additional polymer to maintain a fluid pH value sufficient to hydrate the additional polymer. The hydration of the additional material occurs slowly enough to allow placement within said mold. The buffers and gelling agents are readily available from the various service companies. In recent years improvements in fluid chemistry have led to "one bag" systems which contain all the described dry additives in one container. Comparable gel canisters can be prepared using hydroxyethyl cellulose (HEC) in the described manner using the primary and secondary polymer approach. The HEC is available from Hercules and Henkel.

The second method involves the use of much lower polymer concentrations (60 to 100 lbs/1000 gals of water) where viscosity and stability characteristics have been greatly enhanced by crosslinking with solutions of metallic salts. Because of the molecular structure, guar and derivatized guar (hydroxypropyl guar) lend themselves more satisfactorily to crosslinking than HEC. Therefore, the crosslinked guars are most useful in the present invention. The base gel in this instance would consist of the guar in solution at the described concentrations. Buffers are then used, depending on the crosslinker, to maintain a fluid pH necessary for the crosslink reaction. Several methods have been developed and are known in the prior art as has been suggested herein.

For the guar or hydroxypropyl guar crosslinked with borate, sodium pyrophosphate is used as the buffer, for example, and sodium tetraborate used as the croslinking agent. The buffer concentration ranges from 10 to 20 lbs/1000 gals for example and the borate required ranges from 5 to 15 lbs/1000 gals depending on the amount of guar or hydroxypropyl guar in the base gel. These materials are available from chemical suppliers and service companies such as have been described herein.

Other crosslinkers which are used include salt solutions of transitional metals such as titanium, chromium, and zirconium. Several crosslinker systems using titanium in solution have been developed by DuPont. These include titanium chemically combined with triethanolamine (TYZOR TE) and acetylacetonate (TYZOR AA), as examples. Because of their flexibility and utility, hydroxypropyl guar crosslinked with titanium is a very common present-day fracturing fluid and is available from several service companies; these fluid systems are also known in the prior art. Although not developed to the extent of the titanium crosslinked gel systems, fluids crosslinked with zirconium and chromium are available through the service companies.

Titanium crosslinked gels are more shear and temperature stable than borate gel systems. The buffer system used for titanium crosslinked gel include sodium acetate, sodium bicarbonate, and organic acids. The buffer(s) are mixed into the base gel and the crosslinker is added as the fluid is pumped. Reaction of the crosslink can be controlled by fluid pH and type and concentration of crosslinker solution used.

Of course, as is understood by those skilled in the art, appropriate scaling down of the above proportions can be made depending upon the amount of gel required for said canister 16 and integral retainer stem 14.

In order to withstand pressure generated from a hydrostatic head in deep wells, O-rings can be used to prevent leakage into or out of the solidified gel container. An embodiment of these O-rings is shown in U.S. Pat. No. 4,039,030 issued to Godfrey et al. and which is incorporated by reference herein.

The following example illustrates the invention:

EXAMPLE 1

According to the invention, a slurry is formed with 3785.4 liters (1000 gallons) of water. This slurry comprises 18.4 Kg (40 pounds) of base gel, hydroxypropyl guar gum, which forms a hydrate in the water. To this mixture is added 272.1 Kg (600 pounds) of chemically treated hydroxypropyl guar gum which has delayed hydration or thickening qualities. Then, 9.2 Kg (20 pounds) of sodium pyrophosphate buffer which is suitable to obtain the desired pH and reaction time is added to this mixture. A cross-linking agent consisting of sodium tetra-borate is then added in an amount of 9.2 Kg (20 pounds). This mixture is then poured into the mold containing the flexible porous material as discussed above and allowed to solidify.

Upon ignition of the propellant, heat and pressure is released within the wellbore and into the formation which expands into the formation 10 causing additional fracturing. This heat and pressure produced at a controlled rate causes a fracturing of the hydrocarbonaceous producing formation 10. Upon ignition, the heat and pressure created by the propellant causes a disintegration of the canister 16 which contained the propellant. However, the retrieval cable 18 and ignition line 20 remain intact. Retainer stem 14 formed of materials similar to those used in canister 16 is also disintegrated.

As is understood by those skilled in the art, the composition of a gel canister will depend upon many variables including the propellant used and formation conditions. The above examples are mentioned as two possible variations among many others.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed:

1. A method for making a disposable propellant device for use in controlled pulse fracturing which device is suspended in a wellbore comprising:

(a) forming a disposable outer liner comprised of a flexible porous material consumable upon ignition of a propellant;

(b) impregnating said porous material with a combustible solidifiable gel mixture in an amount sufficient to form a solid enclosure of a thickness capable of containing said propellant;

(c) solidifying said gel to form a solid enclosure in combination with said liner sufficient to contain said propellant while said enclosure is suspended in said wellbore; and (d) enclosing within said liner a propellant means and means for igniting said propellant.

2. The method as recited in claim 1 where in step (a) said liner comprises a nylon fabric material of a gauge sufficient to contain said gel mixture.

3. The method as recited in claim 1 where in step (a) said liner comprises a plastic screen material sufficient to contain said gel mixture.

4. The method as recited in claim 1 where in step (b) said disposable outer liner comprises a gel mixture of hydropropyl guar cross linked with transitional metal ions.

5. The method as recited in claim 4 where in said transitional metal is a member selected from the group consisting of titanium, zirconium, chromium, antimony and aluminum.

6. The method as recited in claim 5 where said transitional metal is included within said gel mixture in an amount of from about 0.005 weight percent to about 0.50 weight percent of said mixture, preferably about 0.01 weight percent.

7. The method as recited in claim 1 where in step (b) said gel is hydropropyl guar which is contained in said mixture in an amount of from about 0.70 to about 10.0 weight percent of said mixture, preferably about 7.2 percent by weight.

8. An apparatus for making a disposable propellant device for use in controlled pulse fracturing which apparatus is suspended in a wellbore comprising:

(a) a means for forming a disposable outer liner comprised of a flexible porous material consumable upon ignition of a propellant;

(b) a means for impregnating said porous material with a combustible solidifiable gel mixture in an amount sufficient to form a solid enclosure of a thickness capable of ccntaining said propellant;

(c) a means for solidifying said gel to form a solid enclosure in combination with said liner sufficient to contain said propellant while said enclosure is suspended in said wellbore; and (d) a means for enclosing within said liner a propellant means and means for igniting said propellant.

9. The apparatus as recited in claim 8 where in step (a) said liner comprises a nylon fabric material of a gauge sufficient to contain said gel mixture.

10. The apparatus as recited in claim 8 where in step (a) said liner comprises a screen made of material sufficient to contain said gel mixture.

11. The apparatus as recited in claim 8 where in step (b) said disposable outer liner comprises a gel mixture of hydropropyl guar cross linked with transitional metal ions.

12. The apparatus as recited in claim 11 where in said transitional metal is a member selected from the group consisting of titanium, zirconium, chromium, antimony and aluminum.

13. The apparatus as recited in claim 12 where said transitional metal is included within said gel mixture in an amount of from about 0.005 weight percent to about 0.50 weight percent of said mixture, preferably about 0.01 weight percent.

14. The apparatus as recited in claim 8 where in step (b) said gel is hydropropyl guar which is contained in said mixture in an amount of from about 0.70 to about 10.0 weight percent of said mixture, preferably about 7.2 percent by weight.

* * * * *